US006135603A

United States Patent [19]

Chen

[11] Patent Number: 6,135,603

[45] Date of Patent: Oct. 24, 2000

[54] ROTATING LIGHTING APPARATUS

[76] Inventor: Hsi-Chin Chen, P.O. Box 82-144, Taipei, Taiwan

[21] Appl. No.: 09/333,014

[22] Filed: Jun. 15, 1999

[51] Int. Cl.[7] ..... F21V 21/30

[52] U.S. Cl. ..... 362/35; 40/430

[58] Field of Search ..... 362/35, 174, 182, 362/170; 40/441

[56] References Cited

U.S. PATENT DOCUMENTS 5,491,616 2/1996 Reed ..... 362/35

5,860,725 1/1999 Zer ..... 362/35

*Primary Examiner*—Sandra O'Shea

*Assistant Examiner*—Hargobind S. Sawhney

*Attorney, Agent, or Firm*—A & J

[57] ABSTRACT

A rotating lighting apparatus and in particular, to a lighting apparatus which makes use of the rising hot air from a burning oil lamp to drive a rotating shade having being mounted with a plurality of blades. The lighting apparatus essentially comprises the rotating shade with the blades, a base perpendicularly mounted with a support tube, a glass shaft seat mounted at the top end of the support tube. The hollow rotating shade is mounted onto the shaft seat via an opening at the center of the shade such that the blades sit onto the shade seat. The hot air from the oil lamp rises to the shade and drives the blades to rotate.

6 Claims, 4 Drawing Sheets

ROTATING LIGHTING APPARATUS

BACKGROUND OF THE INVENTION a) Technical Field of the Invention

The present invention relates to a rotating light apparatus, and in particular, to a lighting apparatus having a cylindrical shade with a plurality of blades at one end thereof and in combination with a centralized positioning frame and a shaft seat, such that the cylindrical shade can rotate about the center of the shaft seat when an oil lamp is lighted and is placed directly below the shade.

b) Description of the Prior Art

Traditionally and culturally, besides offering food stuff to the gods, the worshipper places an oil lamp or the like in the process of worshipping. Light means a bright future and good fortune to the worshippers. Traditionally used lighting apparatus in praying or worshipping has a container filled with solid or liquid burning oil and a wick on the surface of the burning oil. There are various shapes of containers, such as the shape of cylindrical body on a spherical body, or shape of a marrow or a pineapple burning oil container available in the market.

Recently, religion representation or symbols are added to the new designs of burning oil lamp in order to achieve the purpose of creating an elegant or graceful environment.

Referring to FIG. 6, there is show a conventional lighting apparatus having a recessed seat 31 at the top of a support tube to combine with a corresponding protruded conic shaped member 32. The shade without a horizontal support at the internal surface of the shade tends to swing to-and-fro. Accordingly, this conventional lighting apparatus does not show elegant or grace when it is used in religious occasions.

SUMMARY OF THE INVENTION

Therefore, it is an object of the present invention to provide a lighting apparatus with religious symbols thereto, wherein the lighting apparatus is adaptable to any type of oil lamp so that the shade of the lighting apparatus rotates when the hot air of the oil lamp rises upward.

It is another object of the present invention to provide a lighting apparatus, comprises a base adapted for a support tube and a rotating shade being mounted at the top end thereof, and the oil lamp provided directly below the rotating shade, characterized in that an opening is provided at the top center of the shade for the mounting of a shaft seat, and at the internal rim surface of the middle section of the shade is provided with a positioning frame to support the internal rim surface of the shade such that the support tube, passing through the positioning hole, is inserted to the interior of the shaft seat, thereby the shade can rotate in a perfect circle.

Yet another object of the present invention is to provide a lighting apparatus having an oil lamp and with a shaft seat to support a plurality of blades mounted at the end of the shade, wherein, the shaft seat is made from glass material with low frictional coefficient allows the blades to rotate smoothly.

Additional advantages of this invention will become apparent from the description which follows, taken in conjunction with the accompanying drawings.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 2:
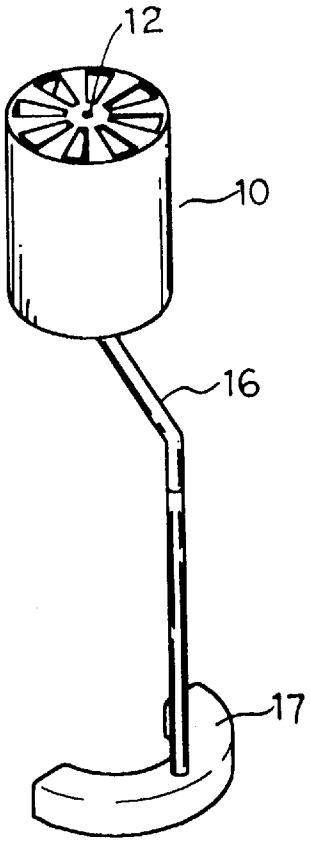
FIG. 2 is perspective view of the rotating lighting apparatus in accordance with the present invention.
Figure 1:
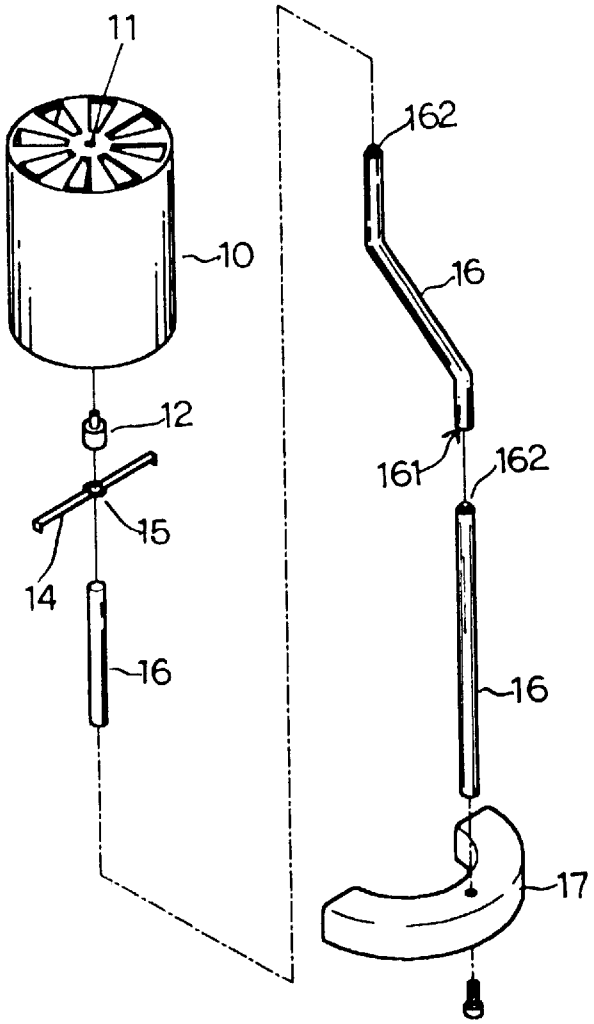
FIG. 1 is a perspective exploded view of a rotating lighting apparatus in accordance with the present invention.
Figure 3:
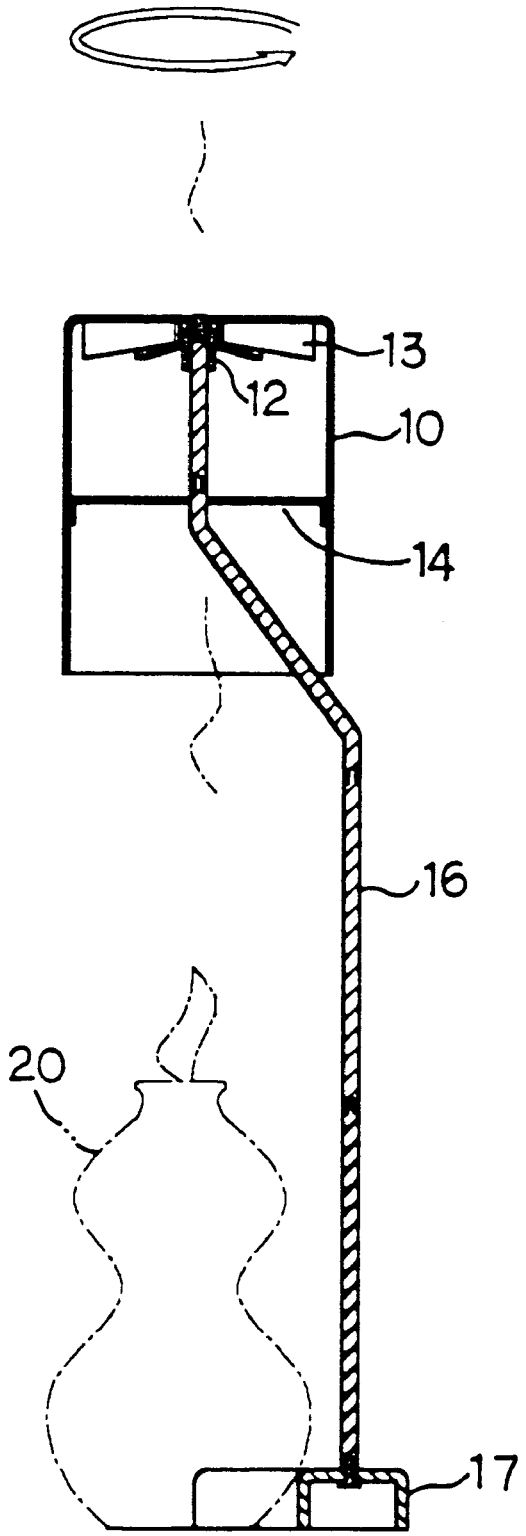
FIG. 3 is a sectional view of the rotating lighting apparatus in accordance with the present invention, showing an oil lamp being placed directly under the shade of lighting apparatus.
Figure 4:
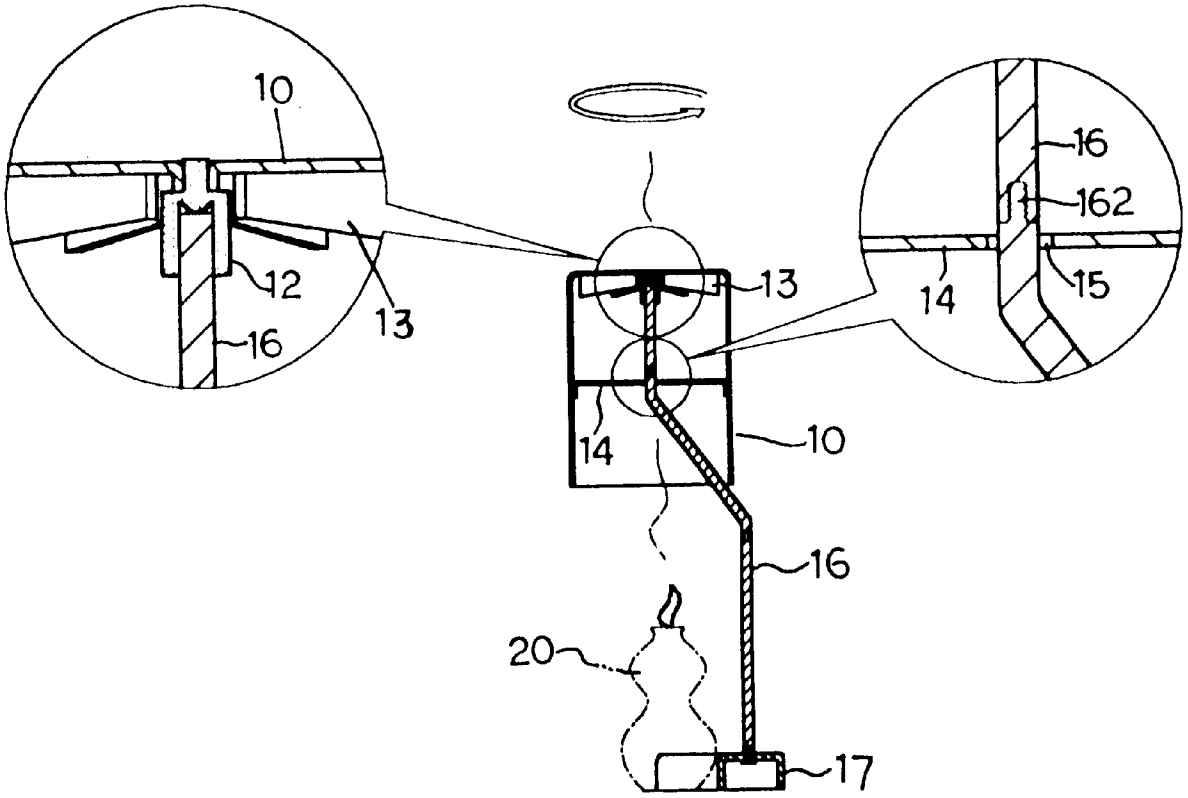
FIG. 4 is a sectional view of the rotating lighting apparatus in accordance with the present invention, showing the supporting of the positioning frame at the middle section of the shade, and the supporting of the shade by the shaft seat.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1 to 4, there is shown a rotating lighting apparatus with an oil lamp 20 comprises a hollow cylindrical shade 10 having a plurality of blades 13 at one end of the shade 10 and having an opening 11 at the center thereof, a shaft seat 12 rotatably mounted to the blades at the opening 11, a horizontal positioning frame 14 having a positioning hole 15 at the center thereof and supporting the shade 10 at the internal rim surface thereof, a multi-sectional support tube 16 having the top end connected to the shaft seat 12 after the positioning hole 15 of the positioning frame 14 passed through the tube 16, and a base 17 supporting the bottom end of the support tube 16.

In accordance with the present invention, the hot air of the burning-oil lamp 20 (refer to FIG. 3) rises upward to the shade 10 will rotate, the shade 10 rotates. The shade 10 is made from thin metallic plate or hard cardboard materials by casting or rolling into a cylindrical shaped, hollow container like structure. The external surface of the shade is painted with religious symbols or elegant diagrammatic patterns for religion activities. At the middle section of the internal surface of the shade 10, an internal rim face is provided so that the horizontal positioning frame 14 can be used to slidably support the shade 10 while it rotates.

In accordance with the present invention, the top end of the support tube 16, passing through the positioning hole 15, is connected to the shaft seat 12. The shaft seat 12 is made from glass materials or materials with low coefficient of expansion or low frictional coefficient to provide smooth rotating of the shade 10 when the center of the blades 13 sit on it.

The support tube 16 is a multi-sectional structure, wherein one end of the tube 16 is provided with a screw holes 161 and the other is a protruded, threaded end 162 such that the hole 161 of the support tube 16 can join to the threaded end 162 of another support tube 16. One bottom end of the support tube 16 is mounted to the base 17 and then fastened with a screw. In accordance to the present invention, the base 17 is a semi-annular shaped structure so that an oil lamp 20 of any shape can be placed at the bottom directly below the shade 10. The base 17 can also be extended to a larger surface area to increase the stability of the lighting apparatus.

Figure 5:
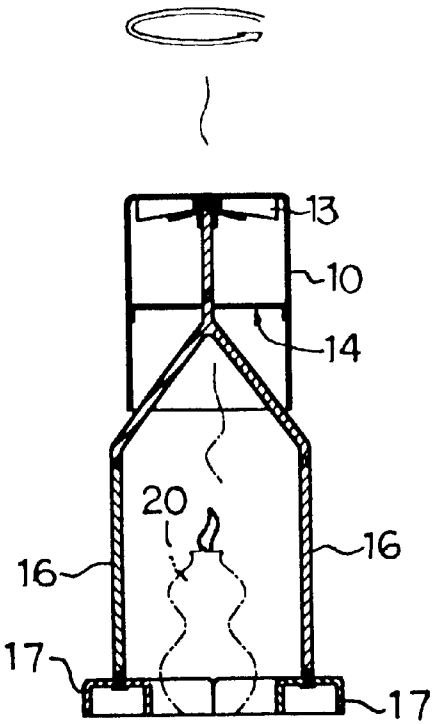
FIG. 5 is a sectional view of another preferred embodiment of a support tube structure in accordance with the present invention.
Figure 6:
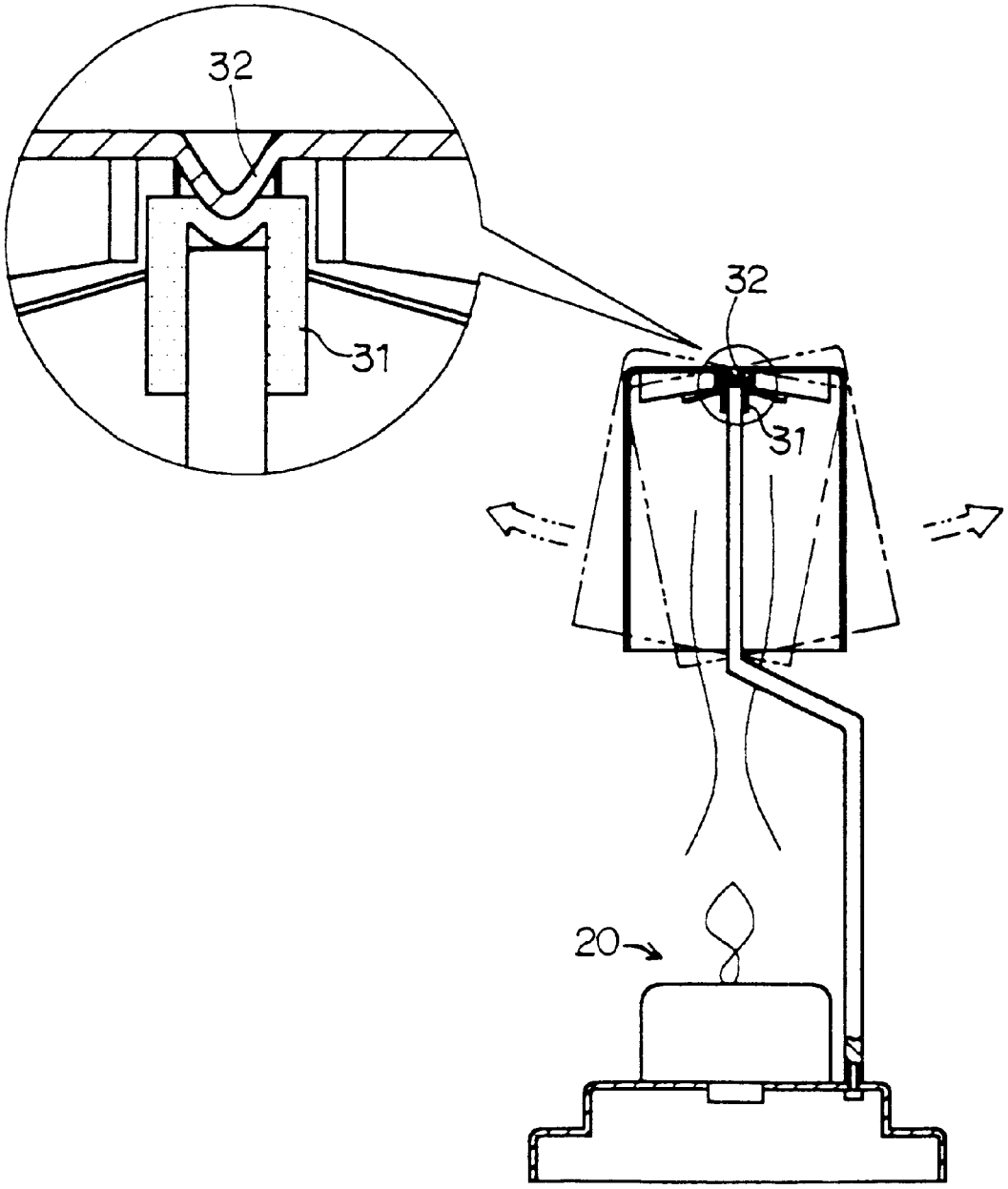
PRIOR ART FIG. 6
FIG. 6 is a schematic view of a conventional single support shade which may eccentrically rotate and dislocate from the seat.

Referring to FIG. 5, there is show another preferred embodiment of the present invention having the support tube 16 being made into a dual isolated support tube with two bottom ends 161 mounted to the base 17. This provides a stable and balance structure and the oil lamp 20 is placed in between the two support tube 16.

The hot air of the oil lamp 20 rises to the shade 10 and rotates the blades 13 as a result of the arrangement of the blades 13. The outer surface of the shade 10 is printed with religious representations or words such as "AMITABAH", "BUDDA OF COMPASSION" etc. Thus a lighting apparatus with graceful and elegant look is obtained.

In accordance with the present invention, the shaft seat 12 made from glass with low frictional coefficient allows the blades 13 to rotate smoothly. The horizontal positioning frame 14 slidably supports the shade 10 at the inner surface thereof will stabilize the shade 10 while the shade 10 is rotating.

While the invention has been disclosed and described with specific preferred embodiments, it will be apparent that variations and modification may be made therein, and it is therefore intended in the following claims to cover each such variation and modification as falls within the scope and the true spirit of the invention.

I claim:

1. A rotating lighting apparatus having an oil lamp comprising a base adapted for a support tube and a rotating shade being mounted at the top end thereof, and the oil lamp provided directly below the rotating shade, characterized in that an opening is provided at the top center of the shade for the mounting of a shaft seat, and at the internal rim surface of the middle section of the shade is provided with a positioning frame to support the internal rim surface of the shade such that the support tube, passing through a positioning hole in the positioning frame is inserted to the interior of the shaft seat, thereby the shade rotates in a perfect circle.

2. A rotating lighting apparatus as set forth in claim 1, wherein the support tube has multiple sections interconnected to allow height adjustment of the support tube.

3. A rotating lighting apparatus as set forth in claim 1, wherein the shaft seat is made from glass materials.

4. A rotating lighting apparatus as set forth in claim 1, wherein the shaft seat is made from materials with low expansion coefficient to heat.

5. A rotating lighting apparatus as set forth in claim 1, wherein the shaft seat is made from material of low frictional coefficient.

6. A rotating lighting apparatus as set forth in claim 1, wherein the base is a semi-annular shape.

* * * * *